US007215301B2

(12) United States Patent
Choi et al.

(10) Patent No.: US 7,215,301 B2
(45) Date of Patent: May 8, 2007

(54) ELECTROMAGNETIC BANDGAP STRUCTURE FOR ISOLATION IN MIXED-SIGNAL SYSTEMS

(75) Inventors: Jinwoo Choi, Atlanta, GA (US); Madhavan Swaminathan, Marietta, GA (US); Vinu Govind, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 226 days.

(21) Appl. No.: 10/936,774

(22) Filed: Sep. 8, 2004

(65) Prior Publication Data

US 2006/0050010 A1 Mar. 9, 2006

(51) Int. Cl.
*H01Q 15/02* (2006.01)
*H01Q 1/38* (2006.01)

(52) U.S. Cl. ..... 343/909; 343/700 MS

(58) Field of Classification Search ..... 343/909, 343/911 R, 756, 700 MS, 753, 789
See application file for complete search history.

(56) References Cited

U.S. PATENT DOCUMENTS 5,923,225 A 7/1999 Los Santos ..... 333/12
6,175,337 B1 * 1/2001 Jasper et al. ..... 343/770
6,426,722 B1 * 7/2002 Sievenpiper et al. . 343/700 MS
6,538,621 B1 * 3/2003 Sievenpiper et al. ..... 343/909
7,042,419 B2 * 5/2006 Werner et al. ..... 343/909
2004/0140945 A1 7/2004 Werner et al.
2004/0239451 A1 12/2004 Ramprasad et al.

OTHER PUBLICATIONS

Sievenpiper, et al; High-Impedance Electromagnetic Surfaces With a Forbidden Frequency Band; IEEE Transactions on Microwave Theory and Techniques; vol. 47, No. 11; Nov. 1999; pp. 2059-2074.
Abhari, et al.; Metallo-Dieletric Electromagnetic Bandgap Structures for Suppression and Isolation of the Parallel-Plate Noise in High-Speed Circuits; IEEE Transactions on Microwave Theory and Techniques; vol. 51, No. 6; Jun. 2003; pp. 1629-1639.
Choi, et al.; Isolation in Mixed-Signal Systems Using a Novel Electromagnetic Bandgap (EBG) Structure; School of Electrical and Computer Engineering, Georgia Institute of Technology; 4 pages.

(Continued)

*Primary Examiner*—Shih-Chao Chen
*Assistant Examiner*—Minh Dieu A
(74) *Attorney, Agent, or Firm*—Thomas, Kayden, Horstemeyer & Risley, LLP

(57) ABSTRACT

Electromagnetic bandgap (EBG) structures, systems incorporating EBG structures, and methods of making EBG structures, are disclosed. An embodiment of the structure, among others, includes a plurality of first elements disposed on a first plane of a device; and a second element connecting each first element to an adjacent first element, the second element being disposed on the first plane of the device. The structure is configured to substantially filter electromagnetic waves to a stopband floor of about −40 dB to about −120 dB in a bandgap of about 100 MHz to about 50 GHz having a width selected from about 1 GHz, 2 GHz, 3 GHz, 5 GHz, 10 GHz, 20 GHz, and 30 GHz. In addition, the structure has a center frequency positioned at a frequency from about 1 GHz to 37 GHz.

19 Claims, 13 Drawing Sheets

OTHER PUBLICATIONS

Kamgaing, et al.; A Novel Power Plane With Integrated Simultaneous Switching Noise Mitigation Capability using HIgh Impedance Surface; IEEE Microwave and Wireless Components Letters; vol. 13, No. 1; Jan. 2003; pp. 21-23.

Choi, et al.; A Novel Electromagnetic Bandgap (EBG) Structure for Mixed-Signal System Applications; School of Electrical and Computer Engineering, Georgia Institute of Technology; 4 pages.

Kamgaing; et al.; Inductance-Enhanced High-Impedance Surfaces for Broadband Simultaneous Switching Noise Mitigation in Power Planes; IEEE MTT-S Digest; 2003; pp. 2165-2168.

Choi, et al.; Isolation in Mixed-Signal Systems Using a Novel Electromagnetic Bandgap (EBG) Structure; School of Electrical and Computer Engineering, Georgia Institute of Technology; 4 pages, no date.

Choi, et al.; A Novel Electromagnetic Bandgap (EBG) Structure for Mixed-Signal System Applications; School of Electrical and Computer Engineering, Georgia Institute of Technology; 4 pages, no date.

Kamgaing; et al.; Inductance-Enhanced High-Impedance Surfaces for Broadband Simultaneous Switching Noise Mitigation in Power Planes; IEEE MTT-S Digest; 2003; pp. 2165-2168, no date.

* cited by examiner

ELECTROMAGNETIC BANDGAP STRUCTURE FOR ISOLATION IN MIXED-SIGNAL SYSTEMS

TECHNICAL FIELD

The present disclosure is generally related to RF/analog and digital circuits, filters, and more particularly, is related to tunable electromagnetic bandgap structures.

BACKGROUND

Radio frequency (RF) front-end circuits like low noise amplifiers (LNAs) need to detect low-power signals and are therefore extremely sensitive in nature. A large noise spike, either in or close to the operating frequency band of the device, can de-sensitize the circuit and destroy its functionality. To prevent this problem, all radio architectures include filters and other narrow band circuits, which prevent the noise in the incoming spectrum from reaching the LNA. However, there are no systematic ways to filter noise from other sources, such as noise coupling through the power supply and appearing at the output of the LNA, where it can degrade the performance of the downstream circuits.

The sensitivity of RF circuits to power supply noise has resulted in difficulties for integration of digital and RF/analog sub-systems on packaging structures. One typical approach to isolate the sensitive RF/analog circuits from the noisy digital circuits is to split the power plane or both power and ground planes. The gap in power plane or ground plane can partially block the propagation of electromagnetic waves. For this reason, split planes are usually used to isolate sensitive RF/analog circuits from noisy digital circuits. Although split planes can block the propagation of electromagnetic waves, part of the electromagnetic energy can still couple through the gap. Due to the electromagnetic coupling, this method only provides a marginal isolation (i.e., −20 dB to −60 dB) at high frequencies (i.e., above ~1 GHz) and becomes ineffective as the sensitivity of RF circuits increases and operating frequency of the system increases. At low frequencies (i.e., below ~1 GHz), split planes provide an isolation of −70 dB to −80 dB.

In addition, split planes sometimes require separate power supplies to maintain the same DC level, which is not cost-effective. Therefore, the development of a better noise isolation method is needed for good performance of a system having a RF/analog circuit and a digital circuit.

Furthermore, as systems become more compact, multiple power supplies become a luxury that the designer cannot afford. The use of ferrite beads have been suggested as a solution to these problems, enabling increased isolation as well as the use of a single power supply. However, due to the high sensitivity of RF circuitry, the amount of isolation provided by ferrite beads again tends to be insufficient at high frequencies.

Electromagnetic bandgap (EBG) structures have become very popular due to their enormous applications for suppression of unwanted electromagnetic mode transmission and radiation in the area of microwave and millimeter waves. EBG structures are periodic structures in which propagation of electromagnetic waves is not allowed in a specified frequency band. In recent years, EBG structures have been proposed to suppress simultaneous switching noise (SSN) in a power distribution network (PDN) in high-speed digital systems for antenna applications. These EBG structures have a thick dielectric layer (60 mils to 180 mils) that exists between the power plane and the ground plane. In addition, these EBG structures require an additional metal layer with via connections. Thus, these EBG structures are expensive solutions for printed circuit board (PCB) applications.

Accordingly, there is a need in the industry to address the aforementioned deficiencies and/or inadequacies.

SUMMARY

Electromagnetic bandgap (EBG) structures, systems incorporating EBG structures, and methods of making EBG structures, are disclosed. A representative embodiment of a structure, among others, includes a plurality of first elements disposed on a first plane of a device, each first element comprising a first metal layer, a dielectric layer; and a second metal layer, wherein each first element has a rectangular shape; and a second element connecting each first element to an adjacent first element at a position adjacent to the corner of the first element, the second element being disposed on the first plane of the device, the second element comprising a first metal layer, a dielectric layer, and a second metal layer. The first elements and second elements substantially filter electromagnetic waves to a stopband floor of about −60 dB to about −120 dB in a bandgap of about 100 MHz to about 50 GHz having a width selected from about 1 GHz, 2 GHz, 3 GHz, 5 GHz, 10 GHz, 20 GHz, and 30 GHz. In addition, the structure has a center frequency positioned at a frequency from about 1 GHz to 37 GHz.

Another embodiment of the structure, among others, includes a plurality of first elements disposed on a first plane of a device; and a second element connecting each first element to an adjacent first element, the second element being disposed on the first plane of the device. The structure is configured to substantially filter electromagnetic waves to a stopband floor of about −40 dB to about −120 dB in a bandgap of about 100 MHz to about 35 GHz having a width selected from about 1 GHz, 2 GHz, 3 GHz, 5 GHz, 10 GHz, 20 GHz, and 30 GHz. In addition, the structure has a center frequency positioned at a frequency from about 1 GHz MHz to 37 GHz.

Another embodiment of the structure for electromagnetic wave isolation in systems containing RF/analog and digital circuits, among others, includes an RF/analog circuit disposed on the structure; a digital circuit disposed on the structure; and electromagnetic bandgap (EBG) structure disposed substantially between the RF/analog circuit and the digital circuit. The EBG structure includes a plurality of first elements, where each first element is connected to another first element by a second element. The first elements connected by the second element form a substantially continuous and periodic structure. The EBG structure is configured to substantially filter electromagnetic waves to a stopband floor of about −40 dB to about −120 dB in a bandgap of about 100 MHz to about 35 GHz having a width selected from about 1 GHz, 2 GHz, 3 GHz, 5 GHz, 10 GHz, 20 GHz, and 30 GHz. In addition, the EBG structure has a center frequency positioned at a frequency from about 1 GHz to 37 GHz A representative method of fabricating a EBG structure, among others, includes: providing a second metal layer, a dielectric layer, and a first metal layer, wherein the dielectric layer is disposed between the first metal layer and the second metal layer; forming a plurality of first elements into the first metal layer; and forming at least one second element into the first metal layer, wherein each first element is connected to another first element by the at least one second element.

Other structures, systems, methods, features, and advantages of the present disclosure will be, or become, apparent to one with skill in the art upon examination of the following drawings and detailed description. It is intended that all such additional structures, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
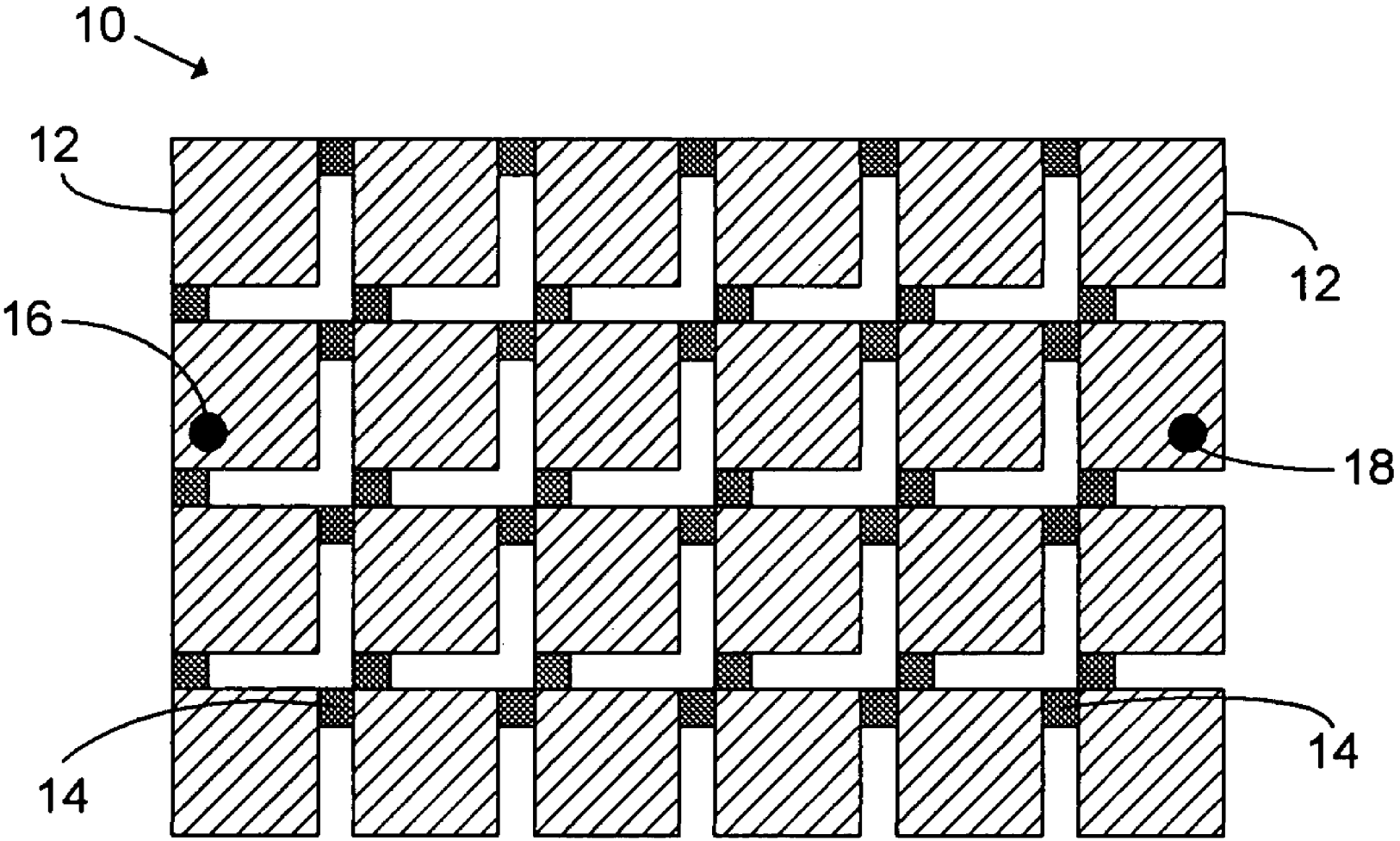
FIG. 1A illustrates a top view of one embodiment of a system having an EBG structure.

Systems having electromagnetic bandgap (EBG) structures and methods of fabrication thereof are described. Embodiments of the present disclosure provide tunable isolation between RF/analog circuits and digital circuits in certain frequency bandgaps by using a plurality of first elements, where each first element is connected to another first element by a second element, thereby forming a continuous, two-dimensional, and periodic structure in the same dimensional plane. In addition, methods of fabrication of EBG structures are disclosed. The first element and the second element can be fabricated by disposing a first metal layer, a dielectric layer, and a second metal layer, to form a plurality of first elements and second elements in the same dimensional plane.

The EBG structures can be designed to have a stopband floor of about −40 dB to −120 dB, −50 dB to −120 dB, −60 dB to −120 dB, about −80 dB to −120 dB, and −dB to −120 dB. In addition, the EBG structure can be designed to have a bandgap that can range from about 100 MHz to 35 GHz having widths of about 1 GHz, 2 GHz, 3 GHz, 5 GHz, 10 GHz, 20 GHz, and 30 GHz (e.g., 500 MHz to 3 GHz, about 3 GHz to 8 GHz, and about 15 GHz to 50 GHz), depending on the stopband floor selected. Since the EBG structure is tunable, the center frequency can be at a pre-selected frequency. In particular, the center frequency can be selected from a frequency from about 1 GHz to 37 GHz.

Although not intending to be bound by theory, the plurality of first elements can be etched in a power plane (or in a ground plane) and connected by the second elements etched in the same dimensional plane to form a distributed LC network (where L is inductance and C is capacitance). The second elements introduce additional inductance while the capacitance is mainly formed by the first elements and the corresponding parts of the other solid plane. The resultant effect is substantial isolation of electromagnetic waves from one or more components positioned on the EBG structures.

EBG structures in the two dimensional plane (i.e., xy plane) are desirable because vias are not required to interconnect components positioned in different dimensional planes. In addition, the design and fabrication are simple as compared to EBG structures having components positioned in different dimensional planes with vias and additional metal patch layers interconnecting the components. Standard planar printed circuit board (PCB) processes can be used to fabricate the structures. For example, the systems having EBG structures can be fabricated using a FR 4 process. In addition, the dielectric thickness can be thin (e.g., 1 mil to bout 4 mils) and thus lower costs.

Furthermore, the EBG structures can be included in, but are not limited to, cellular systems, power distribution systems in mixed-signal package and board, power distribution systems in a high-speed digital package and board, power distribution networks in RF system, and combinations thereof. The compact design of the EBG structures is particularly well-suited for devices or systems requiring minimization of the size of the structure.

FIG. 1A illustrates a top view of one embodiment of a system having an EBG structure 10. The EBG structure 10 includes, but is not limited to, a plurality of first elements 12 continuously connected by a plurality of second elements 14 in the same dimensional plane. At a first location 16 and a second location 18, the EBG structure 10 can also include, but is not limited to, various devices or circuits. At the first location 16, the EBG structure 10 can include, but is not limited to, a port, an RF/analog circuit, and/or a digital circuit. At the second location 18, the EBG structure 10 can include, but is not limited to, a port, an RF/analog circuit, and/or a digital circuit. In one embodiment, a digital circuit is located at the first location 16, while an RF/analog circuit is located at the second location 18.

The first element 12 and the second element 14 can be various shapes. The first elements 12 illustrated in FIG. 1A have square shapes and the second elements 14 illustrated in FIG. 1A also have square shapes. By having the first elements 12 and the second elements 14 each as the same shape, the EBG structure 10 is easy to design, fabricate, and analyze.

It should be noted that the first elements 12 and the second elements 14 can also be other structures that produce sections of high and low impedance. In particular, the first elements 12 and the second elements 14 can each independently be, but are not limited to, polygonal shapes, hexagonal shapes, triangular shapes, circular shapes, or combinations thereof.

The second element 14 can be attached to the first element 12 at various positions. In FIG. 1A, the second elements 14 are attached to the corners of the square first elements 12. However, the second elements 14 can be attached at other positions on the perimeter of the first elements 12, but are shown to be disposed on the edges of the first elements 12 for the best isolation. The simulation results using TMM and a conventional full-wave solver (SONNET) confirm that the second elements 14 disposed on the edges of the first elements 12 showed better isolation than that of the second elements 14 disposed on the centers of the first elements 12.

Figure 1B:
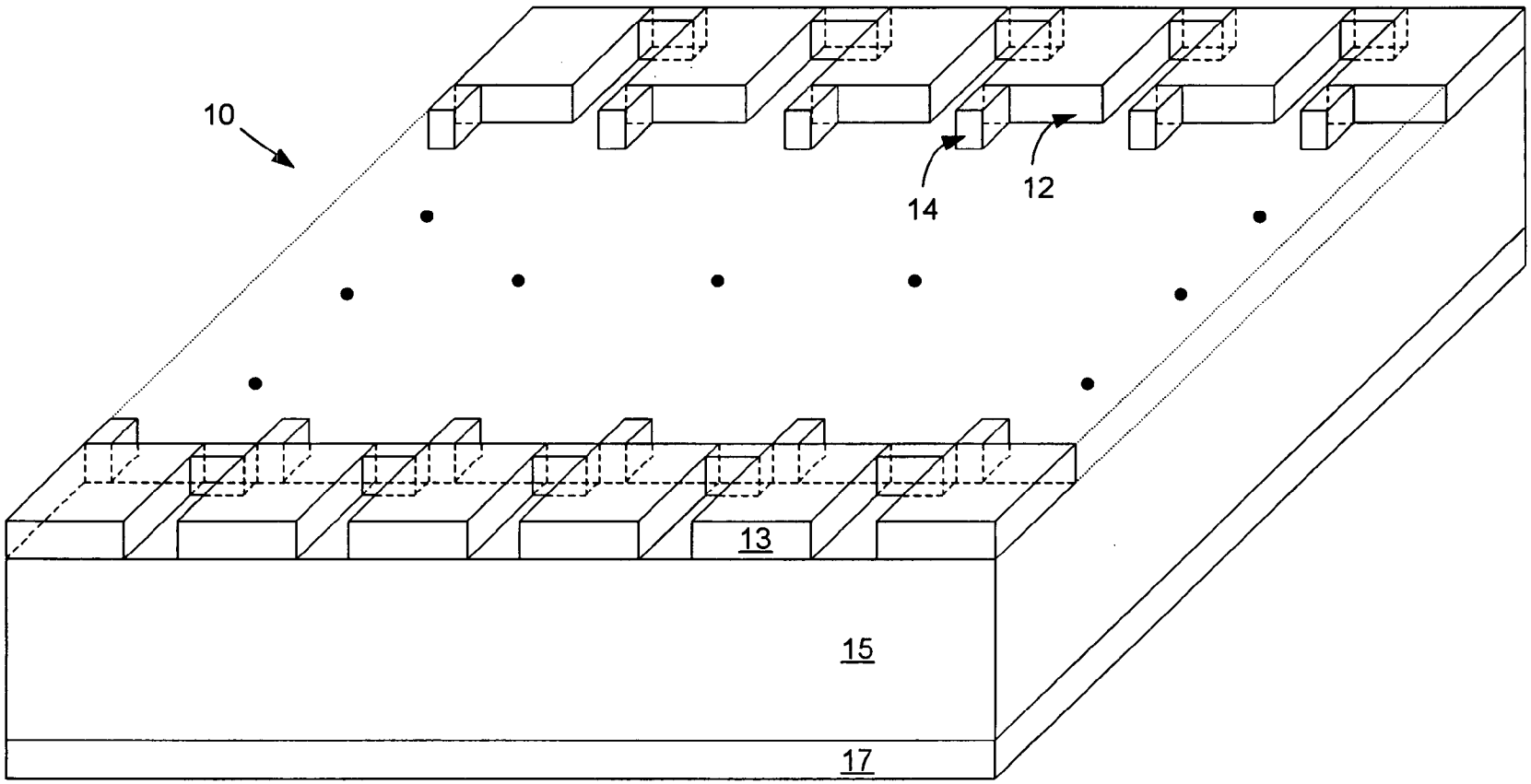
FIG. 1B illustrates a three-dimensional view of the system having the EBG structure.

FIG. 1B illustrates a three-dimensional view of the system having the EBG structure 10. The system having the EBG structure 10 can include, but is not limited to, a first metal layer 13, a dielectric layer 15, and a second metal layer 17. The first metal layer 13 can be included in, but is not limited to, a ground plane or a power plane. For example, the first metal layer 13 can be a power plane etched with first elements 12 and second elements 14 (as shown in FIG. 1B), while the second metal layer 17 can be a continuous metal layer acting as a ground plane. The first metal layer 13 can include, but is not limited to, copper (Cu), palladium (Pd), aluminum (Al), platinum (Pt), chromium (Cr), or combinations thereof. The first metal layer 13 can be, but is not limited to, any material with a conductivity ($\sigma_c$) between about $1.0\times10^6$ S/m and about $6.1\times10^6$ S/m. The first metal layer 13 can have, but is not limited to, a thickness between about 1 mil and 10 mils.

The dielectric layer 15 can be, but is not limited to, a dielectric material with a dielectric constant having a relative permittivity ($\in_r$) of about 2.2 and about 15, and/or a dielectric loss tangent (tan (δ)) of about 0.001 and about 0.3, and combinations thereof. The dielectric layer 15 can include, but is not limited to, FR4, ceramic, and combinations thereof. The dielectric layer 15 can have, but is not limited to, a thickness between about 1 mil and about 100 mils.

The second metal layer 17 can be included in, but is not limited to, a ground plane or a power plane. The second metal layer 17 can include, but is not limited to, Cu, Pd, Al, Pt, Cr, or combinations thereof. The second metal layer 17 can be, but is not limited to, a material with a conductivity ($\sigma_c$) between about $1.0\times10^6$ S/m and about $6.1\times10^6$ S/m. The second metal layer 17 can have, but is not limited to, a thickness between about 1 mil and 10 mils.

Another embodiment can include, but is not limited to, an additional dielectric layer disposed under the second metal layer 17. This additional dielectric layer can provide additional mechanical support to the EBG structure 10.

In general, the length and width of the EBG structure 10 can vary depending on the application. The EBG structure 10 can be fabricated to a length and a width to accommodate consumer and commercial electronics systems.

Figure 2:
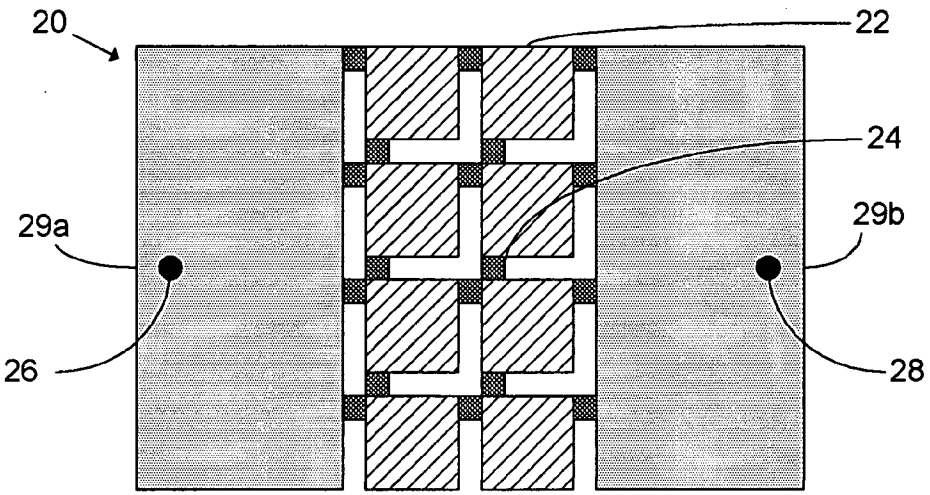
FIG. 2 illustrates a top view of another embodiment of a system having a partial EBG structure.

FIG. 2 illustrates another embodiment of a system having a partial EBG structure 20. The partial EBG structure 20 includes, but is not limited to, a plurality of first elements 22 continuously connected by a plurality of second elements 24. The plane elements 29*a* and 29*b* can be, but are not limited to, a continuous metal layer. At a first location 26 and a second location 28, the system having the partial EBG structure 20 can also include, but is not limited to, various devices or circuits. At the first location 26, the system having the partial EBG structure 20 can include, but is not limited to, a port, a RF/analog circuit, and/or a digital circuit. At the second location 28, the system having the partial EGB structure 20 can include, but is not limited to, a port, a RF/analog circuit, and/or a digital circuit. In one embodiment, a digital circuit is located at the first location 26, while an RF/analog circuit is located at the second location 28.

Figure 3:
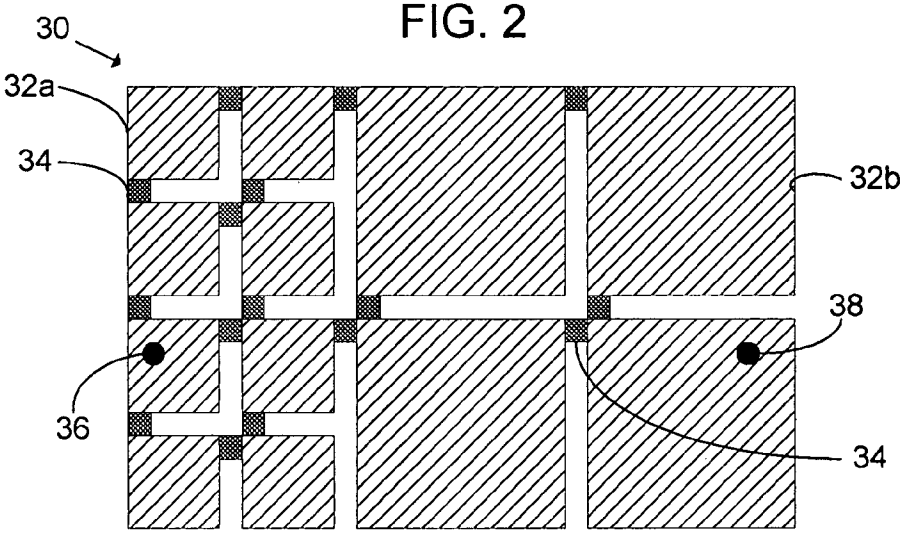
FIG. 3 illustrates a top view of another embodiment of a system having a mixed EBG structure.

FIG. 3 illustrates another embodiment of a system having a mixed EBG structure 30. The mixed EBG structure 30 includes, but is not limited to, a plurality of first elements 32*a* and 32*b* continuously connected by a plurality of second elements 34. The first elements 32*a* are smaller in size than the first elements 32*b*. At a first location 36 and a second location 38, the system having the mixed EBG structure 30 can also include, but is not limited to, various devices or circuits. At the first location 36, the system having the mixed EBG structure 30 can include, but is not limited to, a port, a RF/analog circuit, or a digital circuit. At the second location 38, the system having the partial EBG structure 30 can include, but is not limited to, a port, an RF/analog circuit, or a digital circuit. In one embodiment, a digital circuit is located at the first location 36, while an RF/analog circuit is located at the second location 38.

Using a mixed EBG structure 30 enables the structure to obtain very wide bandgap (e.g., −40 dB bandgap ranged between 500 MHz and 10 GHz). For example, the larger first elements 32*b* and the second elements 34 can produce a bandgap from about 500 MHz to 3 GHz (−40 dB bandgap), while smaller first elements 32*a* and the second elements 34 produce a bandgap from about 3 GHz to 10 GHz (−40 dB bandgap). Thus, a mixed EBG structure can produce an ultra wide bandgap. The ratio between the first element and the second elements could be, but is not limited to, from about 4 to 300.

Now having described the embodiments of the systems having the EBG structures in general, examples 1 to 5 describe some embodiments that are described in J. Choi, V. Govind, and M. Swaminathan, 2004, "A Novel Electromagnetic Bandgap (EBG) Structure for Mixed-Signal System Applications," *IEEE Radio and Wireless Conference*, Atlanta, Ga., September 2004 and in J. Choi, V. Govind, M. Swaminathan, L. Wan, and R. Doraiswami, 2004, "Isolation in Mixed-Signal Systems Using a Novel Electromagnetic Bandgap (EBG) Structure," 13$^{th}$ *Topical Meeting of Electrical Performance of Electronic Packaging* (*EPEP*), Portland, Oreg., October 2004.

While embodiments of systems having the EBG structures are described in connection with examples 1 to 5 and the corresponding text and figures, there is no intent to limit embodiments of the structures to these descriptions. On the contrary, the intent is to cover all alternatives, modifications, and equivalents included within the spirit and scope of embodiments of the present disclosure.

EXAMPLE 1

Figure 4:
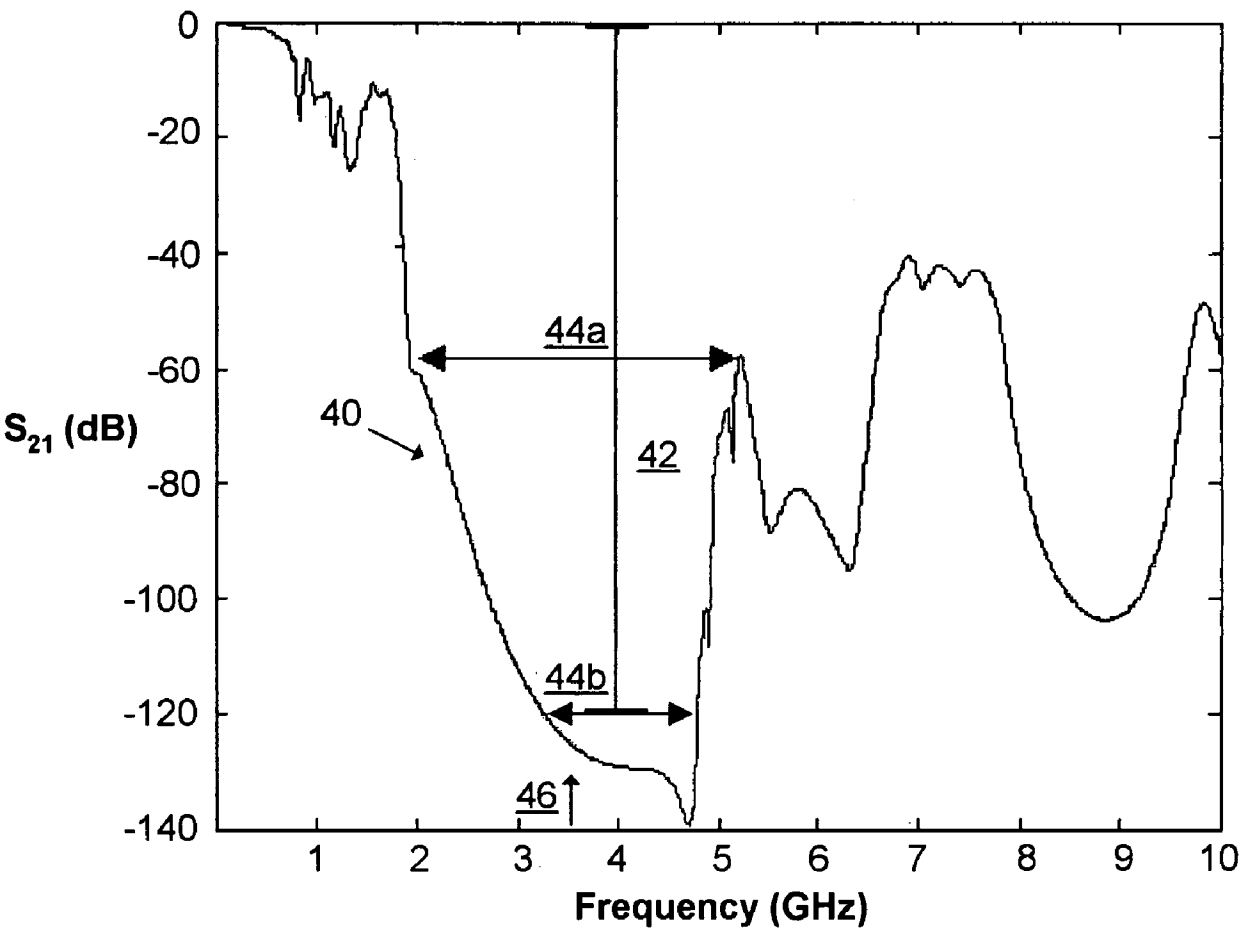
FIG. 4 illustrates one embodiment of a transmission coefficient ($S_{21}$) curve for a system having an EBG structure.

FIG. 4 illustrates one embodiment of a transmission coefficient ($S_{21}$) curve 40. The transmission coefficient ($S_{21}$) curve 40 is produced by the Transmission Matrix Method (TMM), as used to simulate an EBG structure analogous to the EBG structure 10 illustrated in FIG. 1A. TMM is a well-known method for analyzing a periodic power distribution network (PDN) and further information on TMM can be found in J. Kim and M. Swaminathan, "Modeling of irregular shaped power distribution planes using transmission matrix method," *IEEE Trans. Advanced Packaging*, vol. 24, no. 3, pp. 334–346, August 2001 and J. Choi, S. Min, J. Kim, M. Swaminathan, W. Beyene, and X. Yuan, "Modeling and analysis of power distribution networks for gigabit applications," *IEEE Trans. Mobile Computing*, vol. 2, no. 4, pp. 299–313, October–December 2003, which are both incorporated herein by reference. In using the TMM, the EBG structure being simulated includes a first port at a first location and a second port at a second location. The TMM computes the transmission coefficient ($S_{21}$) between the two ports and produces the transmission coefficient curve 40.

The transmission coefficient curve 40 includes, but is not limited to, a stopband floor 42, bandgaps 44*a* and 44*b*, and a center frequency 46. The stopband floor 42 indicates a level of isolation achieved by the EGB structure. In FIG. 4, the stopband floor 42 shown is at about −120 dB. Alternatively, the stopband floor 42 can be, but is not limited to, about −40 dB to −120 dB, about −60 dB to −120 dB, and about −80 dB to −120 dB. In FIG. 4, the bandgap 44*a* (the −60 dB bandgap) is about 3 GHz, while the bandgap 44*b* (the −120 dB band gap) is about 1.5 GHz. Alternatively, the bandgap 44 can be, but is not limited to, about 100 MHz to 3 GHz, about 3 GHz to 8 GHz, and about 15 GHz to 50 GHz. In FIG. 4, the center frequency 46 is about 4 GHz for −120 dB bandgap. The center frequency is 3.5 GHz for −60 dB bandgap in FIG. 5. As the EBG structure is tunable, the center frequency 46 can be at a pre-selected frequency. In particular, the center frequency 46 can be about 1 GHz to 37 GHz.

In the system having an EBG structure modeled to produce the transmission coefficient ($S_{21}$) curve 40 in FIG. 4, the EBG structure has a rectangular shape of about 9.5 cm by 4.7 cm, having two metal layers making up the ground plane and the power plane. The first elements are about 1.5 cm square shapes and the second elements are about 0.1 cm square shapes. The metal layers are copper ($\sigma_c$=about $5.8\times10^7$ S/m). The copper thickness for the power plane and the ground plane is about 35 μm. The dielectric layer of the board is FR4 ($\in_r$=about 4.4 and tan (δ)=about 0.02). The dielectric thickness is about 4.5 mils. Port 1 is placed at a first location (about 0.1 cm, 2.4 cm) and port 2 is placed at a second location (about 9.4 cm, 2.4 cm) with the origin (0, 0) lying at the bottom left corner of the EBG structure.

FR4 laminate is the usual base material from which plated-through-hole and multilayer printed circuit boards are constructed. "FR" stand for "Flame Retardant", and Type "4" indicates woven glass reinforced epoxy resin. The laminate is constructed from glass fabric impregnated with epoxy resin (known as "pre-preg") and copper foil, which is commonly supplied in thicknesses of about a "half-ounce" (about 18 microns) or "one-ounce" (about 35 microns). The foil is generally formed by electrodeposition, with one surface electrochemically roughened to promote adhesion.

The transmission coefficient ($S_{21}$) curve 40 shows a stopband floor 42 (−120 dB) and a broad bandgap 44*a* (over 3 GHz for the −60 dB bandgap and over 8 GHz for the −40 dB bandgap). In TMM, a unit cell size of about 0.1 cm by 0.1 cm, which corresponds to an electrical size of about λ/30 at 10 GHz and the size of the second elements, was used for accurate results. The features of the transmission coefficient ($S_{21}$) curve 40 are summarized in Table 1.

TABLE 1

Features of Transmission Coefficient ($S_{21}$) Curve for the EGB structure of Example 1

| Stopband Floor | Bandgap | Center Frequency |
|---|---|---|
| −60 dB | 3.1 GHz | 3.5 GHz |
| −70 dB | 2.8 GHz | 3.6 GHz |
| −80 dB | 2.5 GHz | 3.7 GHz |
| −90 dB | 2.35 GHz | 3.775 GHz |
| −100 dB | 2.15 GHz | 3.825 GHz |
| −110 dB | 1.78 GHz | 3.86 GHz |
| −120 dB | 1.45 GHz | 4.025 GHz |

EXAMPLE 2

Figure 5:
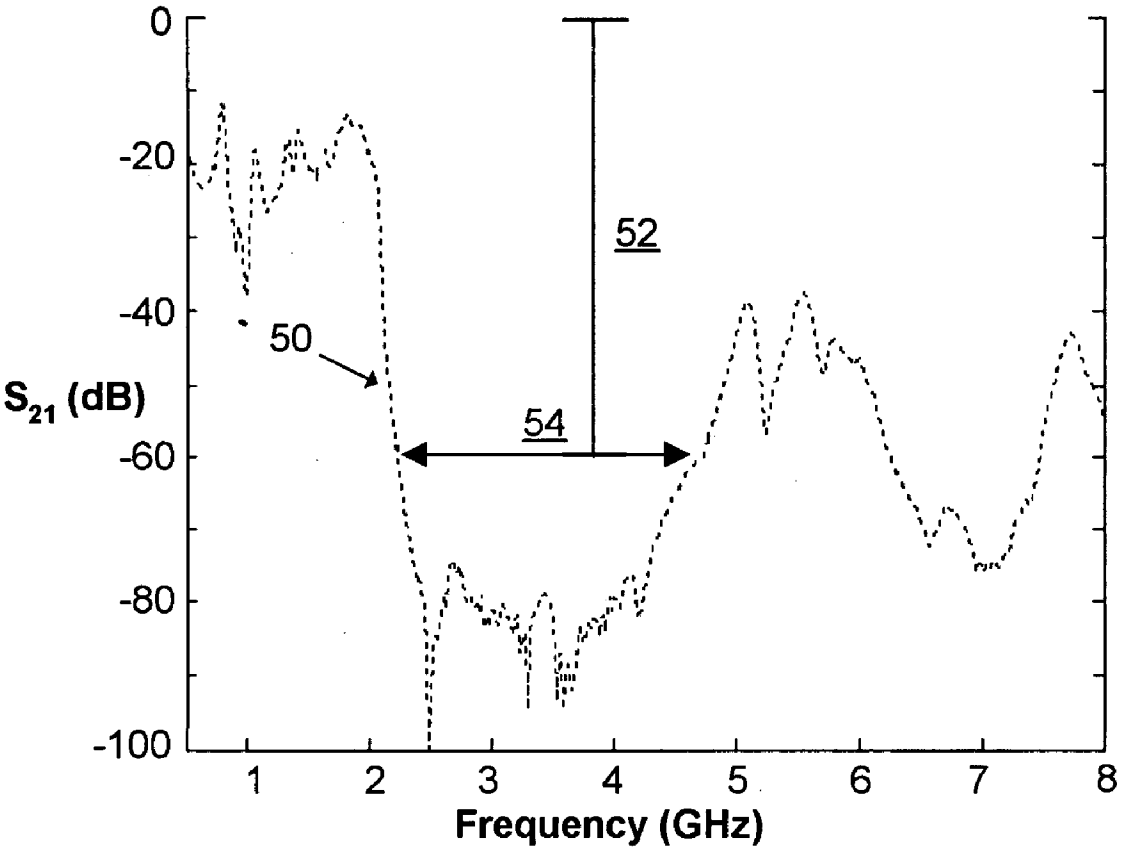
FIG. 5 illustrates another embodiment of a transmission coefficient ($S_{21}$) curve for a system having an EBG structure.

Testing of a system having an EBG structure was carried out using an Agilent 8720 ES vector network analyzer (VNA). FIG. 5 illustrates another embodiment of an transmission coefficient ($S_{21}$) curve 50 for a system having an EBG structure analogous to the EBG structure 10 illustrated in FIG. 1A. The entire EBG structure is a rectangular shape about 9.25 cm by 4.6 cm. The first elements are about 1.5 cm square shapes and the second elements on right side of the first elements are about 0.05 cm by 0.1 cm rectangular shapes and the second elements on top side of the first elements are about 0.1 cm by 0.05 cm. The first elements and second elements are made by etching process. A second metal layer is continuous metal. The metal layers are copper ($\sigma_c$=about $5.8\times10^7$ S/m). A first dielectric layer in between the two metal layers is FR4 ($\in_r$=about 4.4 and tan (δ)=about 0.02). The dielectric thickness is about 8 mils. An additional dielectric layer is disposed under the second metal layer for mechanical support. The additional dielectric layer is FR4 ($\in_r$=about 4.4) and about 28 mils thick.

In FIG. 5, the measured $S_{21}$ shows a very deep and wide bandgap 54 (over 2 GHz) for a −60 dB stopband floor 52. The features of the transmission coefficient ($S_{21}$) curve 50 are summarized in Table 2.

TABLE 2

Features of Transmission Coefficient ($S_{21}$) Curve for EBG structure of Example 2

| Stopband Floor | Bandgap | Center Frequency |
|---|---|---|
| −30 dB | 5.8 GHz | 5.1 GHz |
| −40 dB | 2.95 GHz | 3.675 GHz |
| −50 dB | 2.7 GHz | 3.57 GHz |
| −60 dB | 2.58 GHz | 3.51 GHz |
| −70 dB | 2.1 GHz | 3.35 GHz |
| −80 dB | 1.15 GHz | 3.425 GHz |

Figure 6:
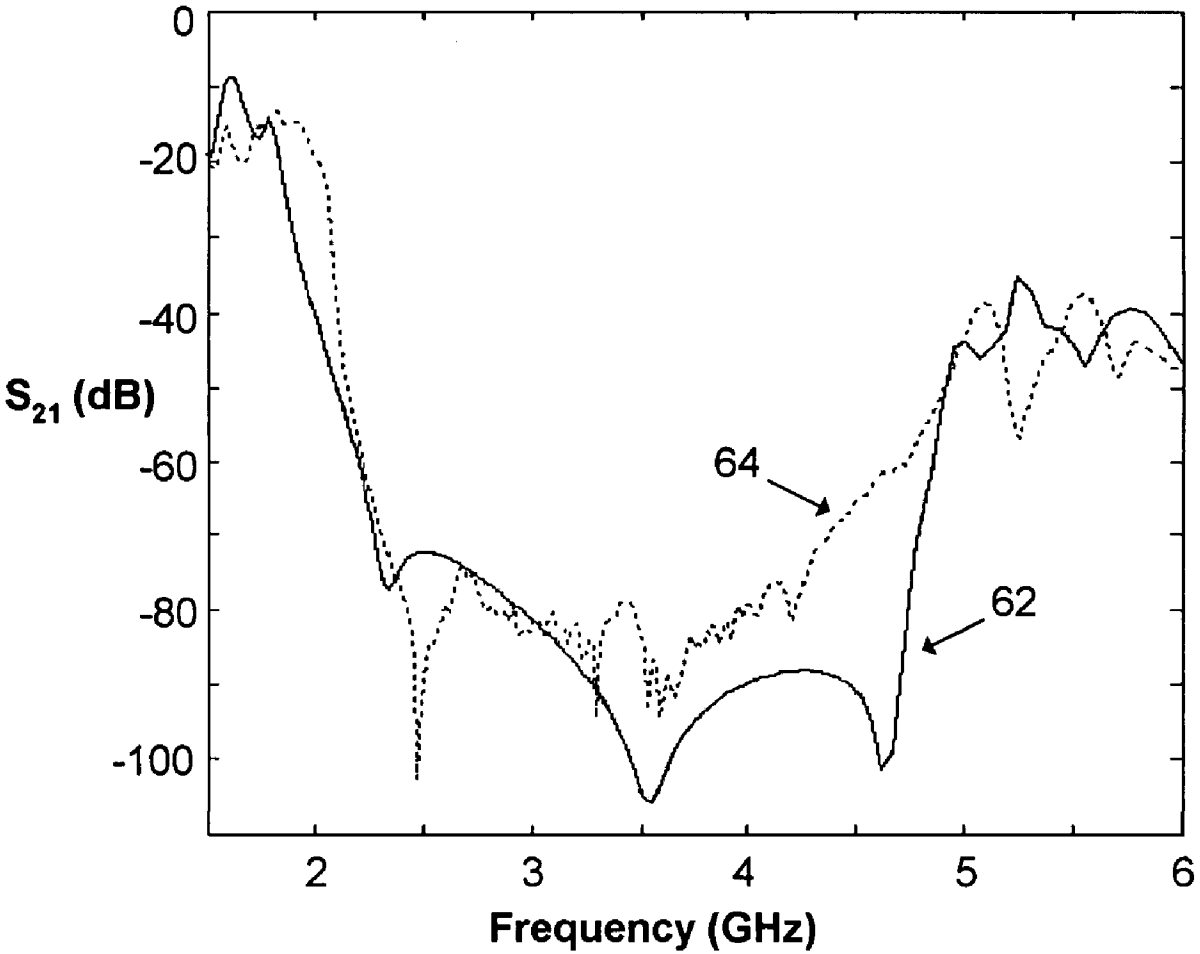
FIG. 6 illustrates an embodiment of a comparison between modeling of a system having an EBG structure using the Transmission Matrix Method (TMM) and measurement of a response of a system having an EBG structure using a vector network analyzer (VNA).

FIG. 6 illustrates an embodiment of a comparison between modeling using the TMM and measurement using the VNA. A good correlation between modeling results 62 and measurement result 64 can be seen in FIG. 6.

Tunability

EXAMPLE 3

Figure 7:
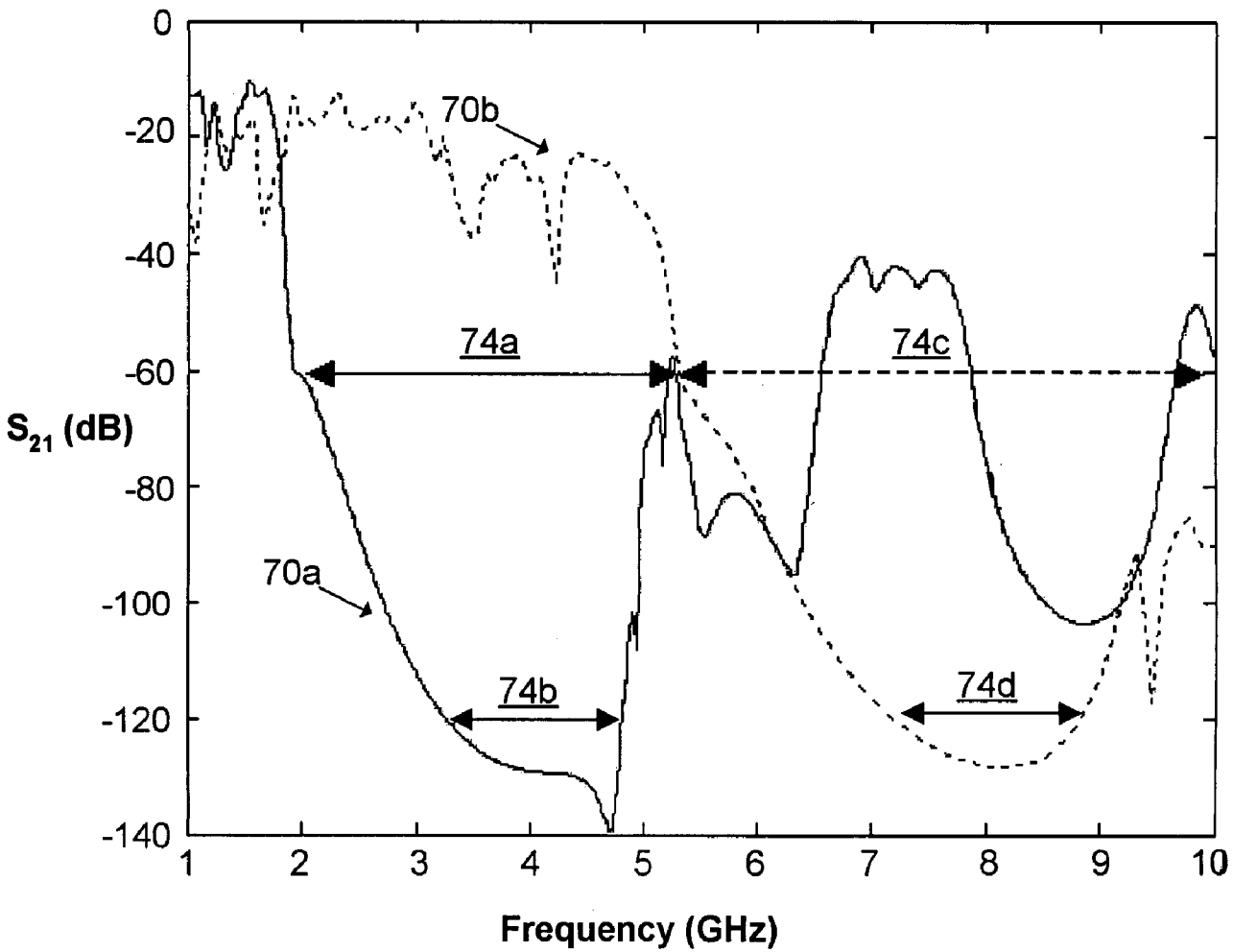
FIG. 7 illustrates two other embodiments of transmission coefficient ($S_{21}$) curves produced using the TMM for systems having an EBG structure.

The frequency tunability of the system having an EBG structure can be seen in FIG. 7, which illustrates two other embodiments of transmission coefficient ($S_{21}$) curves 70*a* and 70*b* produced using the TMM. Two EBG structures (EBG 1 and EBG 2) analogous to the EBG structure 10 illustrated in FIG. 1A were simulated. EBG 1 and EBG 2 include the same metal and dielectric layer makeup as the EBG in Example 1. EBG 1 is a rectangular shape of about 9.5 cm by 4.7 cm. The first elements of EBG 1 are about 1.5 cm square shapes and the second elements of EBG 1 are about 0.1 cm square shapes. EBG 2 is a rectangular shape of about 9.72 cm by 4.8 cm. The first elements of EBG 2 are about 0.7 cm square shapes and the second elements are about 0.12 cm square shapes.

The transmission coefficient ($S_{21}$) curve 70*a* corresponds to EBG 1 while the transmission coefficient ($S_{21}$) curve 70*b* corresponds to EBG 2. The −60 dB bandgap for EBG 1 spanned from about 1.8 GHz to about 5.3 GHz, while the −60 dB bandgap for EBG 2 was from about 5.3 GHz to over about 10 GHz. The −120 dB bandgap for EBG 1 spanned from about 3.4 GHz to about 4.8 GHz, while the −120 dB bandgap for EBG 2 was from about 7.3 GHz to over about 8.8 GHz. Thus, the transmission coefficient ($S_{21}$) curves 70*a* and 70*b* show that the EBG structures disclosed are tunable. The features of the transmission coefficient ($S_{21}$) curves 70*a* and 70*b* are summarized in Tables 3 and 4, respectively.

TABLE 3

Features of Transmission Coefficient ($S_{21}$) Curve for EBG 1 structure of Example 3

| Stopband Floor | Bandgap | Center Frequency |
|---|---|---|
| −60 dB | 3.1 GHz | 3.5 GHz |
| −70 dB | 2.8 GHz | 3.6 GHz |
| −80 dB | 2.5 GHz | 3.7 GHz |
| −90 dB | 2.35 GHz | 3.775 GHz |
| −100 dB | 2.15 GHz | 3.825 GHz |
| −110 dB | 1.78 GHz | 3.86 GHz |
| −120 dB | 1.45 GHz | 4.025 GHz |

TABLE 4

Features of Transmission Coefficient ($S_{21}$) Curve for EBG 2 structure of Example 3

| Stopband Floor | Bandgap | Center Frequency |
|---|---|---|
| −60 dB | 4.8 GHz | 7.6 GHz |
| −70 dB | 4.3 GHz | 7.85 GHz |
| −80 dB | 4.0 GHz | 8.0 GHz |
| −90 dB | 3.35 GHz | 7.925 GHz |
| −100 dB | 2.7 GHz | 7.85 GHz |
| −110 dB | 2.25 GHz | 7.875 GHz |
| −120 dB | 1.6 GHz | 8.0 GHz |

EXAMPLE 4

Figure 8D:
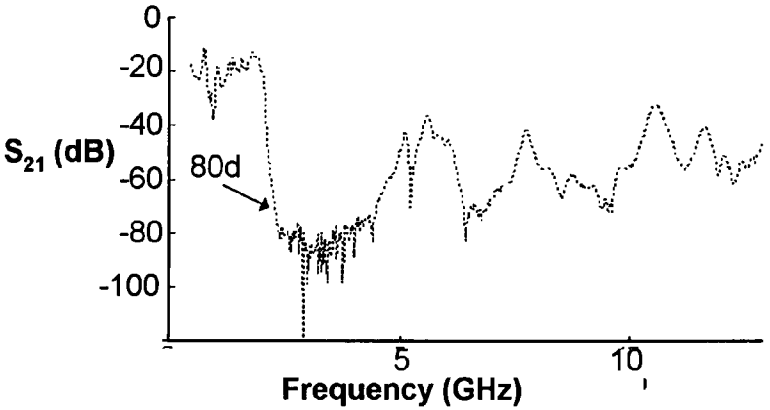
FIGS. 8D–8F illustrate transmission coefficient ($S_{21}$) measurements corresponding to the EBG structures in FIGS. 8A–8C.
Figure 8E:
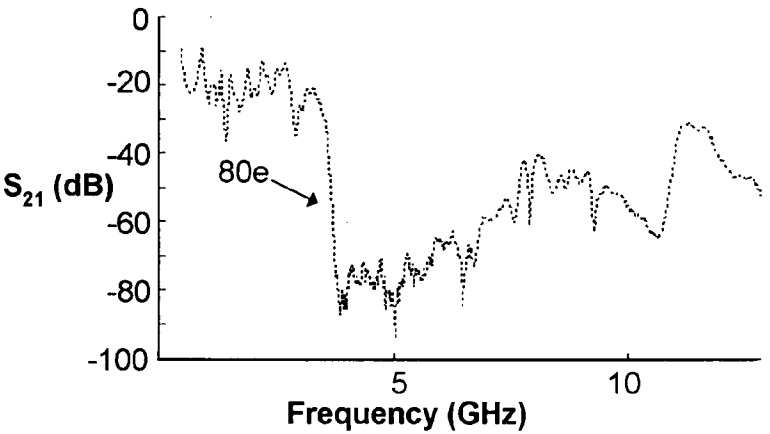
Figure 8A:
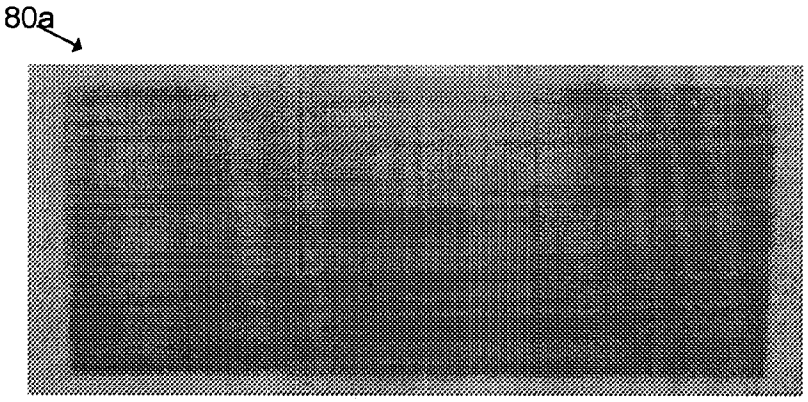
FIGS. 8A–8C illustrate three additional embodiments of systems having an EBG structure.
Figure 8B:
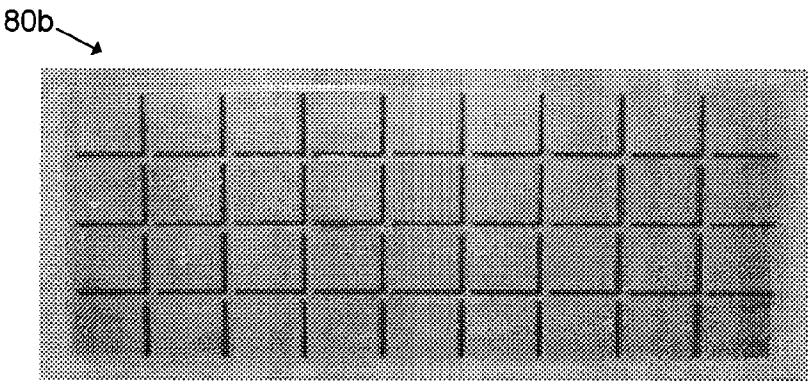
Figure 8F:
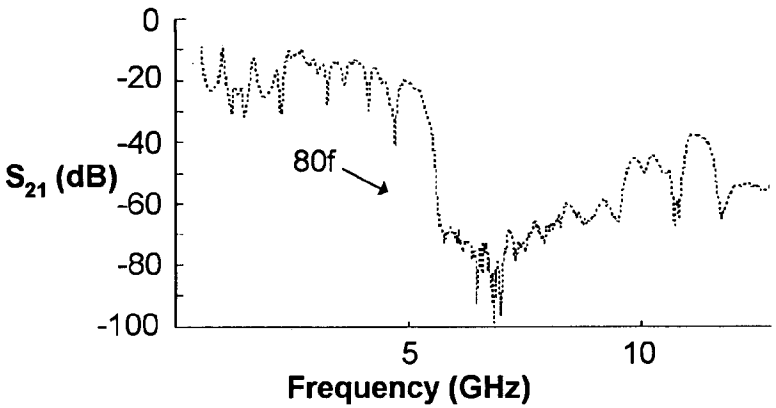
Figure 8C:
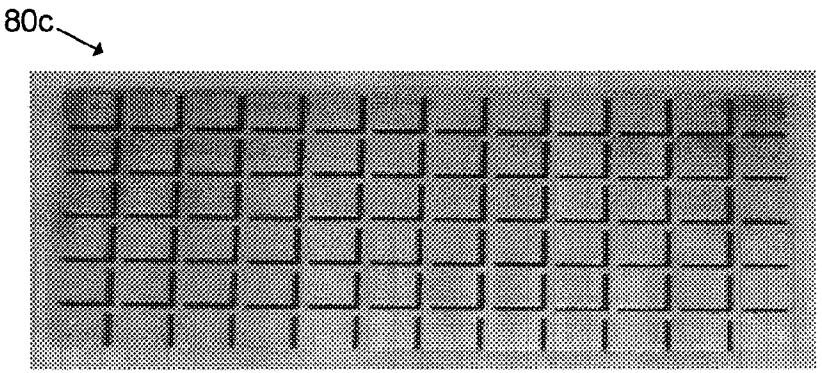

Additional testing of other embodiments of systems having an EBG structure was carried out using VNA. FIGS. 8A–8C illustrate three additional embodiments of systems 80*a*, 80*b*, and 80*c* having an EBG structure analogous to the EBG structure 10 illustrated in FIG. 1A. The size of the first elements was changed in the three different EBG structures to further demonstrate the tunability of systems having the EBG structures. FIGS. 8D–8F illustrate embodiments of transmission coefficient ($S_{21}$) curves 80*d*, 80*e*, and 80*f* corresponding to the EBG structures in FIGS. 8A–8C.

For the EBG structures in FIGS. 8A–8C, the first elements and second elements are etched into a first metal layer. A second metal layer is continuous metal. The metal layers are copper ($\sigma_c$=about $5.8\times10^7$ S/m). A first dielectric layer in between the two metal layers is FR4 ($\in_r$=about 4.4 and tan (δ)=about 0.02). The dielectric thickness is about 8 mils.

FIG. 8A illustrates an EBG structure 80*a* that is a rectangular shape of about 9.25 cm by 4.6 cm. The first elements of the EBG structure 80*a* are about 1.5 cm square shapes and the second elements on right side of the first elements are about 0.05 cm by 0.1 cm rectangular shapes and the second elements on top side of the first elements are about 0.1 cm by 0.05 cm. EBG structure 80*a* produced the transmission coefficient ($S_{21}$) curve 80*d* with a center frequency 86*d* of about 3.51 GHz for the −60 dB bandgap in FIG. 8D.

FIG. 8B illustrates an EBG structure 80*b* that has a rectangular shape of about 9.8 cm by 4.3 cm. The first elements of the EBG structure 80*b* are about 1 cm square shapes and the second elements are about 0.1 cm square shapes. EBG structure 80*b* produced the transmission coefficient ($S_{21}$) curve 80*e* with a center frequency 86*e* of about 5.2 GHz for the −60 dB bandgap in FIG. 8E.

FIG. 8C illustrates an EBG structure 80*c* that has a rectangular shape of about 9.5 cm by 4.7 cm. The first elements of the EBG structure 80*c* are about 0.7 cm square shapes and the second elements are about 0.1 cm square shapes. EBG structure 80*c* produced the transmission coefficient ($S_{21}$) curve 80*f* with a center frequency 86*f* of about 7.5 GHz for the −60 dB bandgap in FIG. 8F.

Alternatively, systems having EBG structures can be, but are not limited to be, tunable by changing the materials used in fabrication of the EBG structures. For example, the EGB structures can be tuned by changing the material included in the dielectric layer.

Power Distribution System Noise Filtering

EXAMPLE 5

Figure 9:
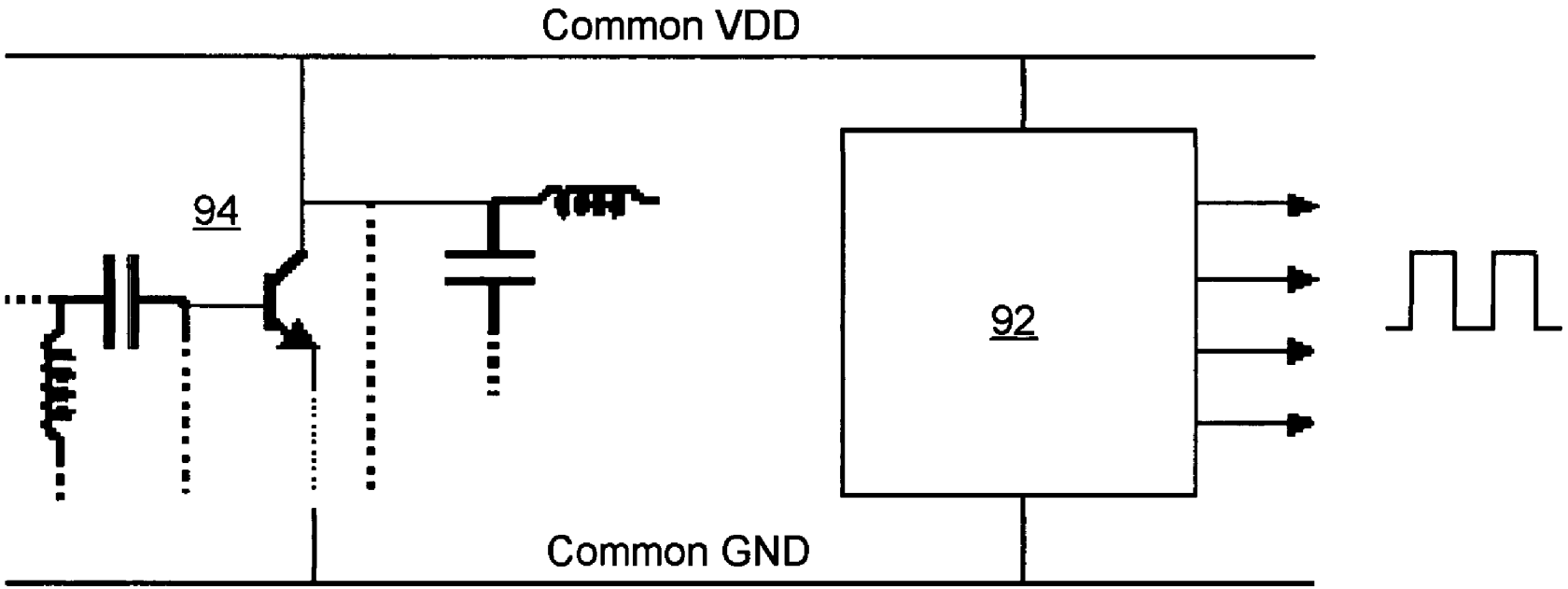
FIG. 9 illustrates one embodiment of a test vehicle used to study noise coupling in SOP-based RF/analog and digital systems.

FIG. 9 illustrates one embodiment of a test vehicle used to study noise coupling in a SOP-based RF/analog and digital system. A common power distribution system is used for supplying power to an FPGA 92 driving an about 300 MHz bus and a low noise amplifier (LNA) 94 operating at 2.13 GHz. Noise generated in the digital sub-system couples to the LNA 94 through the power rails.

Figure 10:
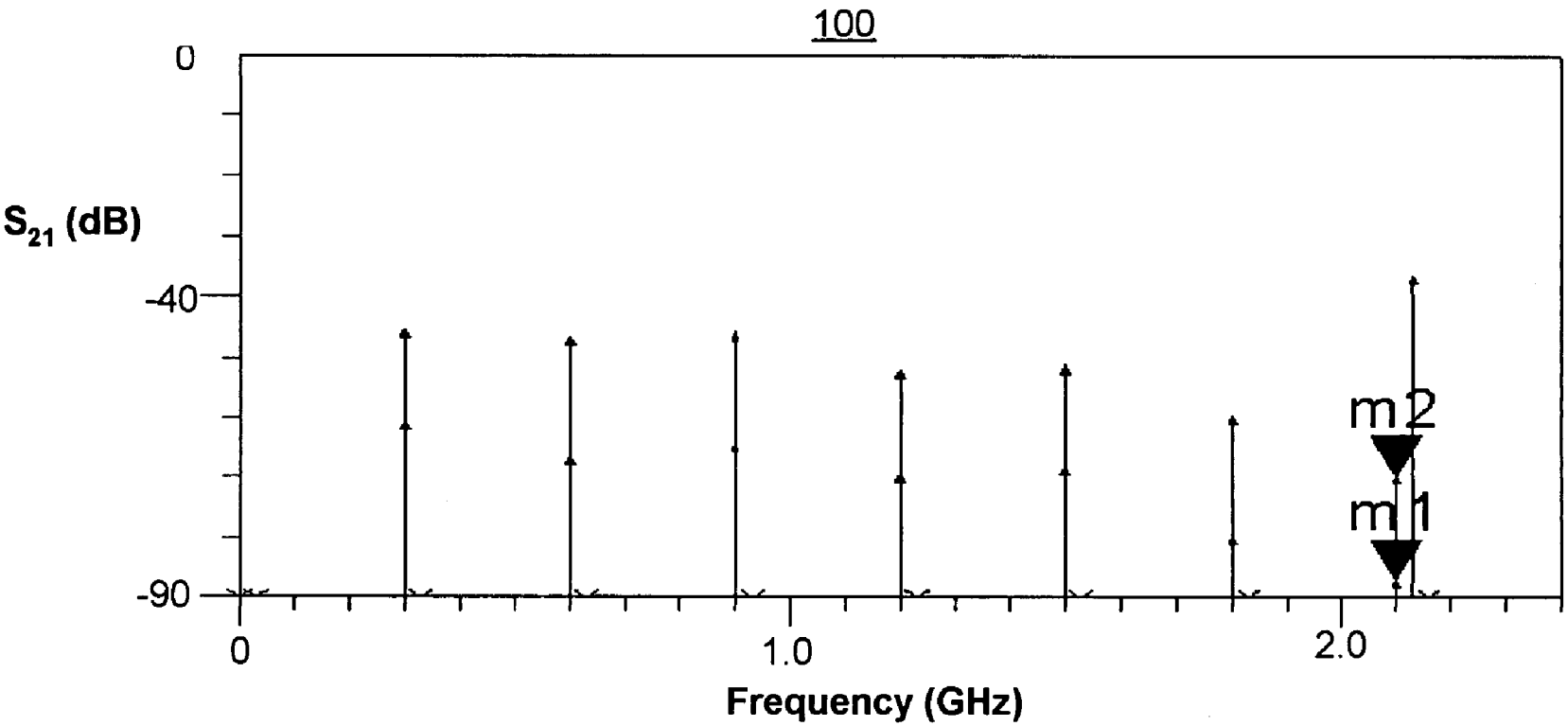
FIG. 10 illustrates one embodiment of a simulated LNA output spectrum 100 (using HP-ADS™), where a power distribution system has been implemented with and without an EBG structure.

FIG. 10 illustrates one embodiment of a simulated LNA output spectrum 100 (using HP-ADS™), where the power distribution system has been implemented with and without an EBG structure. The harmonics of the digital noise couple into the LNA 94 and appear at its output in both cases. However, for the system with the EBG based power scheme, there is significant reduction of the noise amplitudes. In particular, the seventh harmonic of the 300 MHz FPGA 92 (at 2.1 GHz) lies close to the frequency of operation of the LNA 94. For the system without the EBG based power scheme, the amplitude of the noise spike m2 is about −69.592 dBm. However, for the noise spike m1 representing the EBG system, the harmonic has been suppressed to about −87.113 dBm.

Thus, use of an EBG structure in the implementation of the power distribution system provides a cost-effective and compact means for noise suppression, as compared to the use of split planes with multiple power supplies.

Alternating Impedence EBG/Stepped-Impedance EBG

Figure 11:
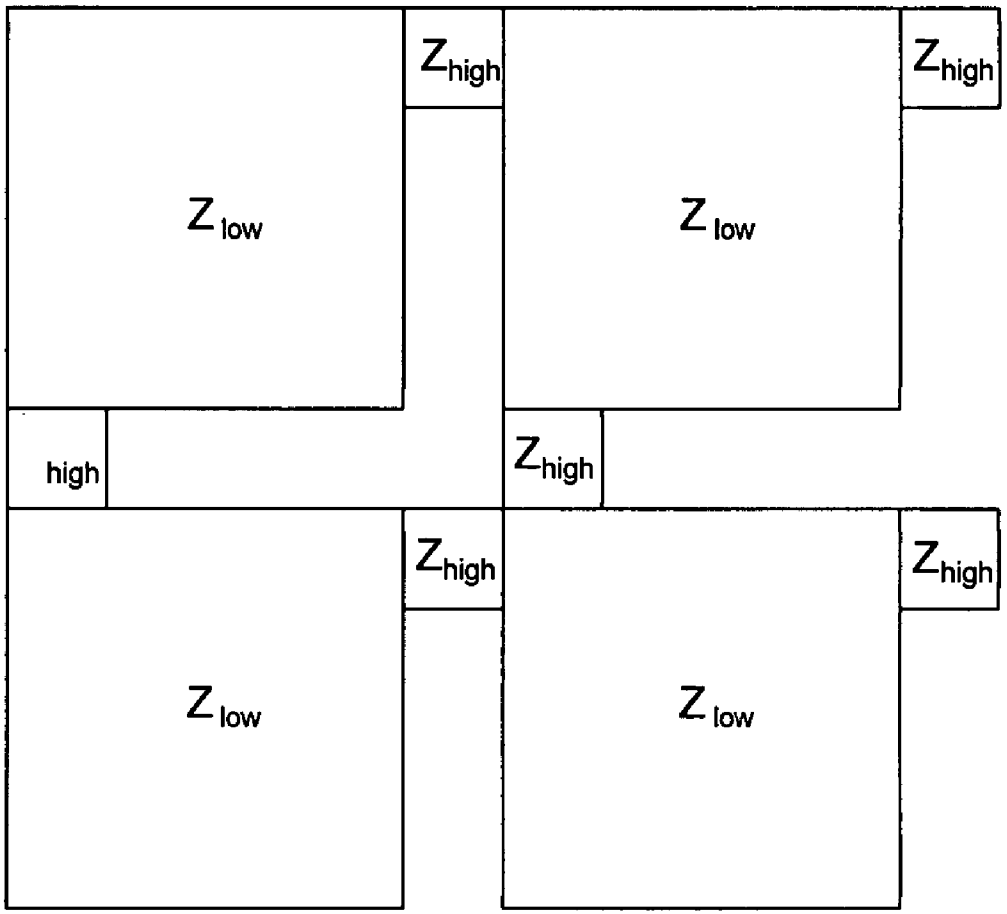
FIG. 11 illustrates one embodiment of an EBG structure represented as alternating sections of high and low characteristic impedance.

Although not intending to be bound by theory, this EBG structure can be called an alternating impedance EBG (AI-EBG) or stepped-impedance EBG (SI-EBG) structure, since this EBG structure includes the alternating sections of high and low characteristic impedance. FIG. 11 illustrates one embodiment of this characteristic. In one sense, the EBG structures can be described as two-dimensional parallel-plate waveguides with alternating perturbation of characteristic impedance. A first element etched in a first metal layer including a dielectric layer and the corresponding part of the second solid metal layer can be represented as a parallel-plate waveguide having a low characteristic impedance. A second element etched in a first metal layer including a dielectric layer and the corresponding part of the second solid metal layer can be treated as a parallel-plate waveguide having a high characteristic impedance.

The characteristic impedance in a parallel-plate waveguide for a TEM mode, $Z_0$ which is the dominant mode for a structure with a very thin dielectric thickness, is given by $$Z_0 = \frac{\eta d}{w} = \sqrt{\frac{L}{C}}$$

where η is intrinsic impedance of the dielectric layer, d is the dielectric thickness, w is the width of the first element or width of the second element, and L and C are inductance and capacitance per volume for the first element including the dielectric layer and the corresponding part of the second solid metal layer, or for the second element including the dielectric layer and the corresponding part of the second solid metal layer. Due to this impedance perturbation, wave propagation is forbidden in a frequency band.

Figure 12A:
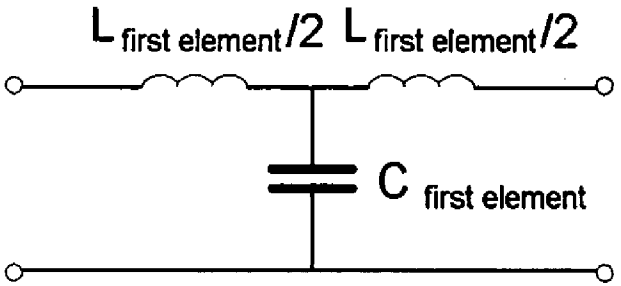
FIGS. 12A–12C illustrate embodiments of the one-dimensional (1-D) T-type equivalent circuits of the elements of the systems having an EBG structure.
Figure 12B:
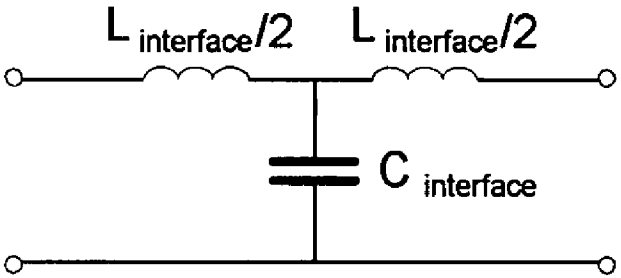
Figure 12C:
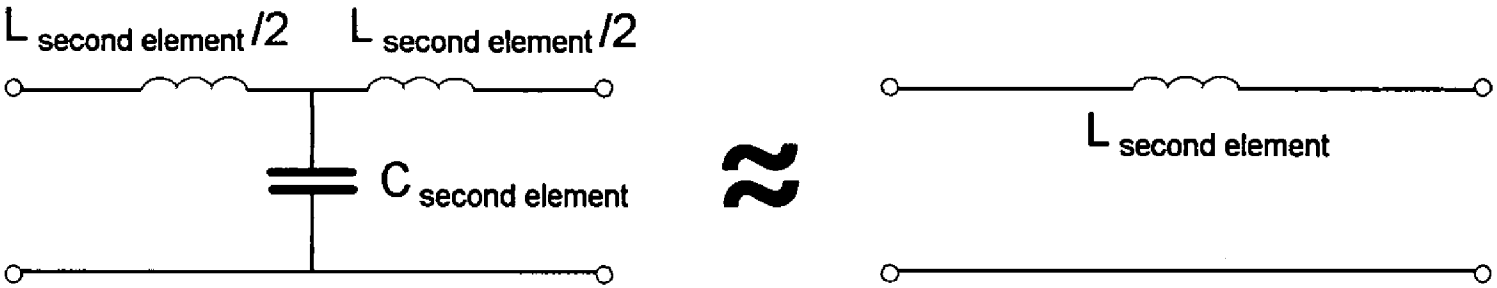

The EBG structure behavior can also be explained using filter theory. FIG. 12A illustrates one embodiment of the one-dimensional (1-D) T-type equivalent circuit of the first element including the dielectric layer and the corresponding part of the second solid metal layer. FIG. 12C illustrates one embodiment of the 1-D equivalent circuit of the second element including the dielectric layer and the corresponding part of the second solid metal layer. In FIG. 12C, $C_{second\ element}$ is very small compared with $L_{second\ element}$ and can be neglected since $C_{second\ element}$ is a capacitance which is formed by a second element and the corresponding part of the second solid metal layer. In FIGS. 12A and 12C, R (resistance) and G (conductance) components are not shown for simplicity. In addition to these LC elements of the first element and second element, there are parasitic reactances at the interface between the first element and the second element, as shown in FIG. 12B, due to a discontinuity caused by the change in width. It is clear that the two dimensional (2-D) LC network of the EBG structure is a low-pass filter (LPF), which has been verified through the simulations and measurements in the previous sections.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

It should be emphasized that the above-described embodiments of the present disclosure are merely possible examples of implementations, merely set forth for a clear understanding of the principles of the disclosure. For example, the systems having the EBG structures can be fabricated of multiple materials. Therefore, many variations and modifications may be made to the above-described embodiment(s) of the disclosure without departing substantially from the spirit and principles of the disclosure. All such modifications and variations are intended to be included herein within the scope of this disclosure and protected by the following claims.

The invention claimed is:

1. A structure comprising:

a plurality of first elements disposed on a first plane of a device, each first element comprising a first metal layer, a dielectric layer, and a second metal layer, wherein each first element has a rectangular shape;

a second element connecting each first element to an adjacent first element at a position on a side of the first element adjacent to a corner of the first element, the second element being disposed on the first plane of the device, the second element comprising a first metal layer, a dielectric layer, and a second metal layer, wherein the first elements and second elements substantially filter electromagnetic waves to a stopband floor of about −60 dB to about −120 dB in a bandgap of about 100 MHz to about 50 0Hz having a width selected from about 1 GHz, 2 GHz, 3 GHz, 5 GHz, 10 GHz, 20 GHz, and 30 GHz, and having a center frequency positioned at a frequency from about 1 GHz to 37 GHz; and wherein the plurality of first elements and second elements form a continuous, two-dimensional and periodic structure.

2. The structure of claim 1, wherein the stopband floor is about −80 dB to about −120 dB.

3. A structure comprising:

a plurality of first elements disposed on a first plane of a device; and a second element connecting each first element to an adjacent first element at a position on a side of the first element adjacent to a corner of the first element the second element being disposed on the first plane of the device, wherein the first elements connected by the second element form a continuous, two-dimensional and periodic structure, wherein the structure is configured to substantially filter electromagnetic waves to a stopband floor of about −40 dB to about −120 dB in a bandgap of about 100 MHz to about 50 GHz having a width selected from about 1 GHz, 2 GHz, 3 GHz, 5 GHz, 10 GHz, 20 GHz, and 30 GHz, and having a center frequency positioned at a frequency from about 1 GHz to 37 GHz.

4. The structure of claim 3, wherein the stopband floor is about −50 dB to about −120 dB.

5. The structure of claim 3, wherein to stopband floor is about −80 dB to about −120 dB.

6. The structure of claim 3, wherein the bandgap is about 500 MHz to about 3 GHz.

7. The structure of claim 3, wherein the bandgap is 3 GHz to about 8 GHz.

8. The structure of claim 3, wherein each first element comprises:

a first metal layer disposed on a dielectric layer; and the dielectric layer disposed on a second metal layer.

9. The structure of claim 8, wherein each first element comprises:

a first metal layer selected from: copper, aluminum, platinum, and combinations thereof;

a dielectric layer selected from: FR4, ceramic, and combinations thereof; and a second metal layer selected from: copper, aluminum, platinum, and combinations thereof.

10. The structure of claim 8, wherein the second element comprises:

a first metal layer disposed on a first dielectric layer; and the dielectric layer disposed on a second metal layer.

11. The structure of claim 10, wherein the second element comprises:

a first metal layer selected from: copper, aluminum, platinum, and combinations thereof;

a dielectric layer selected from: FR4, ceramic, and combinations thereof; and a second metal layer selected from: copper, aluminum, platinum, and combinations thereof.

12. The structure of claim 3, wherein the first elements are a shape selected from: a square shape, a rectangular shape, a polygonal shape, a hexagonal shape, a triangular shape, a circular shape, and combinations thereof.

13. The structure of claim 3, wherein the first elements have a dimension of length of about 0.1 cm to about 20 cm, a width of about 0.1 cm to about 20 cm, and a thickness of about 1 mil to about 10 mils.

14. The structure of claim 3, wherein the second element is a shape selected from: a square shape, a rectangular shape, a polygonal shape, a hexagonal shape, a triangular shape, a circular shape, and combinations thereof.

15. The structure of claim 3, wherein the second element is a shape having a dimension of length about 1 mil to about 1 cm, width about 1 mil to about 1 cm, and thickness about 1 mil to about 10 mils.

16. The structure of claim 3, wherein the first elements arc rectangular shapes and wherein the second element is connected to the first elements at a position adjacent to the corner of the rectangular shapes.

17. A structure for electromagnetic wave isolation in systems containing RF/analog and digital circuits comprising:

an RF/analog circuit disposed on the structure;

a digital circuit disposed on the structure; and an electromagnetic bandgap (EBG) structure disposed substantially between the RF/analog circuit and the digital circuit, wherein the EBG structure includes a plurality of first elements, wherein each first element is connected to another first element by a second element at a position on a side of the first element adjacent to a corner of the first element, wherein the first elements connected by the second element form a continuous and periodic structure, wherein the EBG structure is configured to substantially filter electromagnetic waves to a stopband floor of about −50 dB to about −120 dB in a bandgap of about 100 MHz to about 50 GHz having a width selected from about 1 GHz, 2 GHz, 3 GHz, 5 GHz. 10 GHz, 20 GHz, and 30 GHz, and having a center frequency positioned at a frequency from about 1 GHz to 37 GHz.

18. The structure of claim 17, wherein the structure is included in a system selected from: a cellular system, a power distribution system in any mixed-signal package and board, a power distribution system in any high-speed digital package and board, and combinations thereof.

19. A method of fabricating a tunable EBG structure comprising:

providing a second metal layer;

providing a dielectric layer;

providing a first metal layer, wherein the dielectric layer is disposed between the first metal layer and the second metal layer;

forming a plurality of first elements into the first metal layer; forming a second element into the first metal layer, wherein the second element connects one of a plurality of first elements to another first element at a position on a side of the first element adjacent to a corner of the first element; and wherein the plurality of first elements and second elements form a continuous, two-dimensional and periodic structure.

* * * * *